US005090312A

United States Patent [19]

Ohinata

[11] Patent Number: 5,090,312

[45] Date of Patent: Feb. 25, 1992

[54] MIMEOGRAPHIC PRINTING MACHINE

[75] Inventor: Yoshiharu Ohinata, Toride, Japan

[73] Assignee: Riso Kagaku Corporation, Tokyo, Japan

[21] Appl. No.: 659,945

[22] Filed: Feb. 25, 1991

[30] Foreign Application Priority Data

Mar. 6, 1990 [JP] Japan ..... 2-52775

[51] Int. Cl.[5] ..... B41L 13/00

[52] U.S. Cl. ..... 101/120; 101/116

[58] Field of Search ..... 101/114, 116, 120, 127.1, 101/128.1, 119, 127; 118/406, 409

[56] References Cited

U.S. PATENT DOCUMENTS 4,846,057 7/1989 Endo et al. ..... 101/120
4,911,069 3/1990 Hayama et al. ..... 101/127.1
5,060,567 10/1991 Hayama et al. ..... 101/120

FOREIGN PATENT DOCUMENTS 69086 4/1983 Japan ..... 101/119
104854 5/1986 Japan ..... 101/116

*Primary Examiner*—Edgar S. Burr
*Assistant Examiner*—Ren Yan
*Attorney, Agent, or Firm*—Kanesaka and Takeuchi

[57] ABSTRACT

A mimeographic printing machine comprises a rotary cylindrical drum having an ink-penetrable tubular wall for supporting a stencil on an outer circumferential surface thereof, and a device disposed outside the cylindrical drum for holding a paper sheet between the stencil on the outer circumferential surface of the cylindrical drum to perform printing. The ink-penetrable tubular wall of the cylindrical drum has an opening communicating with a hollow interior of the cylindrical drum, and an ink-impenetrable portion ahead of the opening in the rotating direction of the cylindrical drum, with a trailing end of the ink-impenetrable portion being inserted into the opening.

6 Claims, 4 Drawing Sheets

MIMEOGRAPHIC PRINTING MACHINE

BACKGROUND OF THE INVENTION

1. Field of the Invention

This invention relates to a mimeographic printing machine having a rotary cylindrical drum of an ink-leak-free structure 2. Description of the Related Art A mimeographic printing machine is currently known which includes a rotary cylindrical drum with an ink supply means located inside an ink-penetrable tubular wall, and a press roller located outside said cylindrical drum. For printing, a stencil is wound on the outer circumferential surface of the tubular wall of the cylindrical drum, whereupon the cylindrical drum is driven to rotate while a paper sheet is supplied between the cylindrical drum and the press roller. While the paper sheet is being moved as held between the cylindrical drum and the press roller, ink is transferred to the paper sheet through the tubular wall and pores of the stencil. Thus an image formed by the pores is printed on the paper sheet.

During the above printing, the ink supplied from the inner circumferential surface of the cylindrical drum passes the pores of the stencil and are then transferred to the paper sheet, thus being consumed little by little. At the trailing end portion of the stencil off the printing area, since there is no pore, excessive ink would accumulate between the outer circumferential surface of the cylindrical drum and the stencil. In this state, continued printing of many paper sheets increases an amount of collected excessive ink. In addition to this, the ink is pushed off gradually to the trailing end portion of the stencil by the squeezing action of the press roller, and finally, the ink would overflow off the trailing end portion of the stencil to make the machine portions around dirty. This phenomenon is commonly called "tail end leakage".

SUMMARY OF THE INVENTION

It is therefore an object of this invention to provide a mimeographic printing machine in which ink is prevented from leaking from the trailing end of a stencil wound on a cylindrical drum.

According to the invention, there is provided a mimeographic printing machine comprising: a rotary cylindrical drum including an ink-penetrable tubular wall for supporting a stencil on an outer circumferential surface thereof, the cylindrical drum being rotatable with the stencil supported thereon, there being an ink supply means inside the cylindrical drum; pressing mean disposed outside the cylindrical drum for pressing a paper sheet against the stencil on the outer circumferential surface of the cylindrical drum to perform printing; the ink-penetrable tubular wall of the cylindrical drum having an opening communicating with the hollow interior of the cylindrical drum; and the tubular wall having an ink-impenetrable portion ahead of the opening in the rotating direction of the cylindrical drum, a trailing end of the ink-impenetrable portion being inserted into the opening.

With this arrangement, printing takes place on the paper sheet held between the pressing means and the cylindrical drum as the latter is driven to rotate. The ink supplied to the inner circumferential surface of the tubular wall of the cylindrical drum by the ink supply means passes through the ink-penetrable tubular wall and the ink-penetrable screen to reach the stencil, whereupon the ink is transferred to the paper sheet through pores of the stencil. The excessive ink that passed the tubular wall of the cylindrical drum and was not used in printing, would collect between the tubular wall and the ink-penetrable screen and would be pushed toward the trailing end of the screen as printing progresses. This excessive ink is pushed out from the ink-impenetrable screen and the tubular wall and is returned to the interior of the cylindrical drum from the opening via the ink-impenetrable screen.

Specifically, the tubular wall of the cylindrical drum includes an ink-penetrable screen wound on outer circumferential surface of the tubular wall. The ink-penetrable screen being adapted to support the stencil on its outer surface, the ink-penetrable screen having the ink-impenetrable portion at a trailing margin.

Further, the cylindrical drum includes a tubular net constituting the tubular wall, and an attachment base having a pair of end disks each attached to one of opposite ends of the tubular net.

The tubular net is preferably a sheet form connected at its leading end directly to the attachment base and at its trailing end to the attachment base via a tension spring.

The ink-impenetrable portion is connected to the attachment base via a tension spring.

The above and other advantages, features and additional objects of this invention will be manifest to those versed in the art upon making reference to the following detailed description and the accompanying drawings in which a preferred structural embodiment incorporating the principles of this invention is shown by way of illustrative example.

DETAILED DESCRIPTION

The principles of this invention are shown particularly when embodied in a mimeographic printing machine 1 such as shown in FIGS. 1 through 4, generally designated by the numeral 1.

Figure 1:
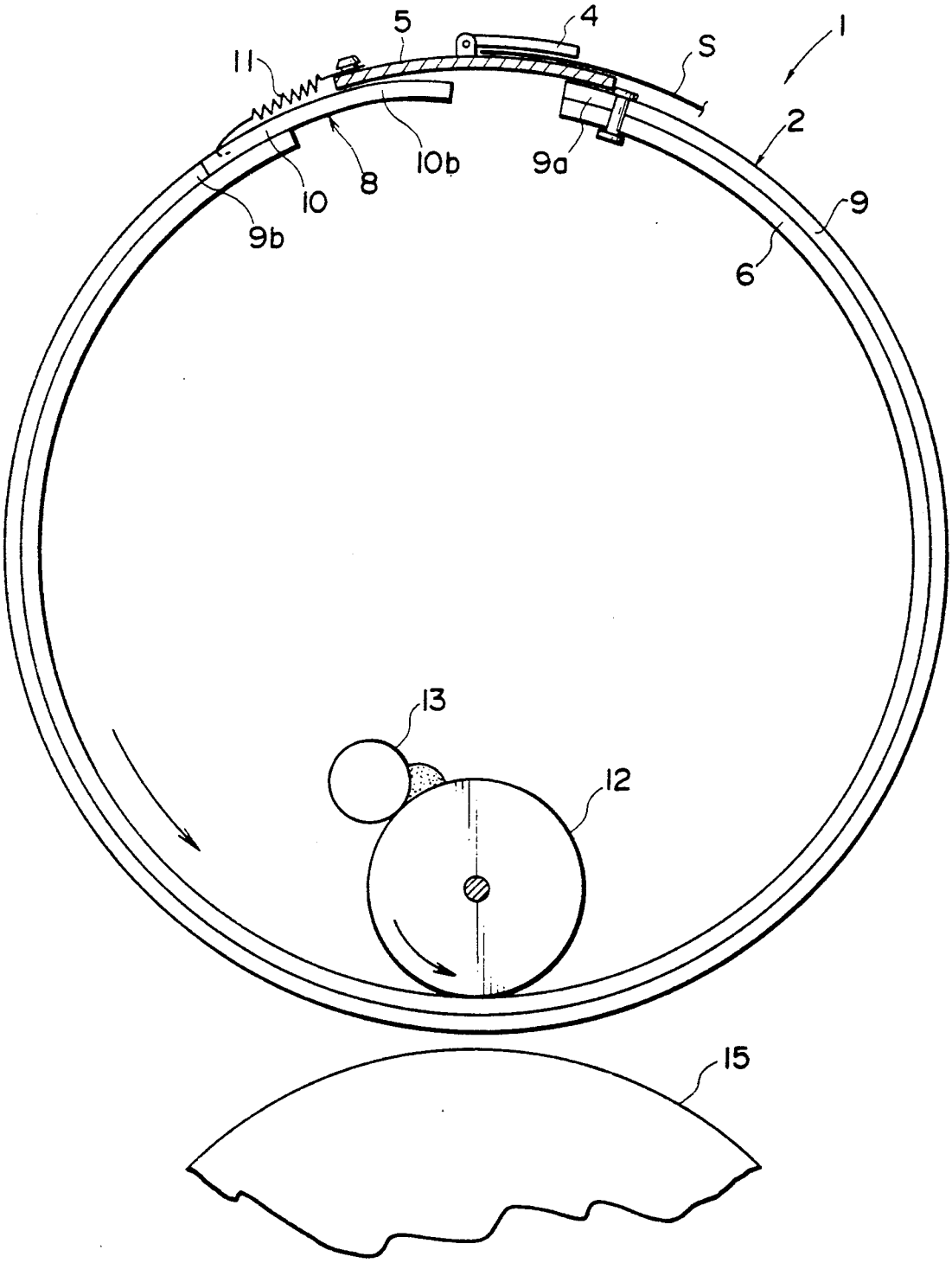
FIG. 1 is a fragmentary transverse cross-sectional view of a mimeographic printing machine embodying this invention.
Figure 2:
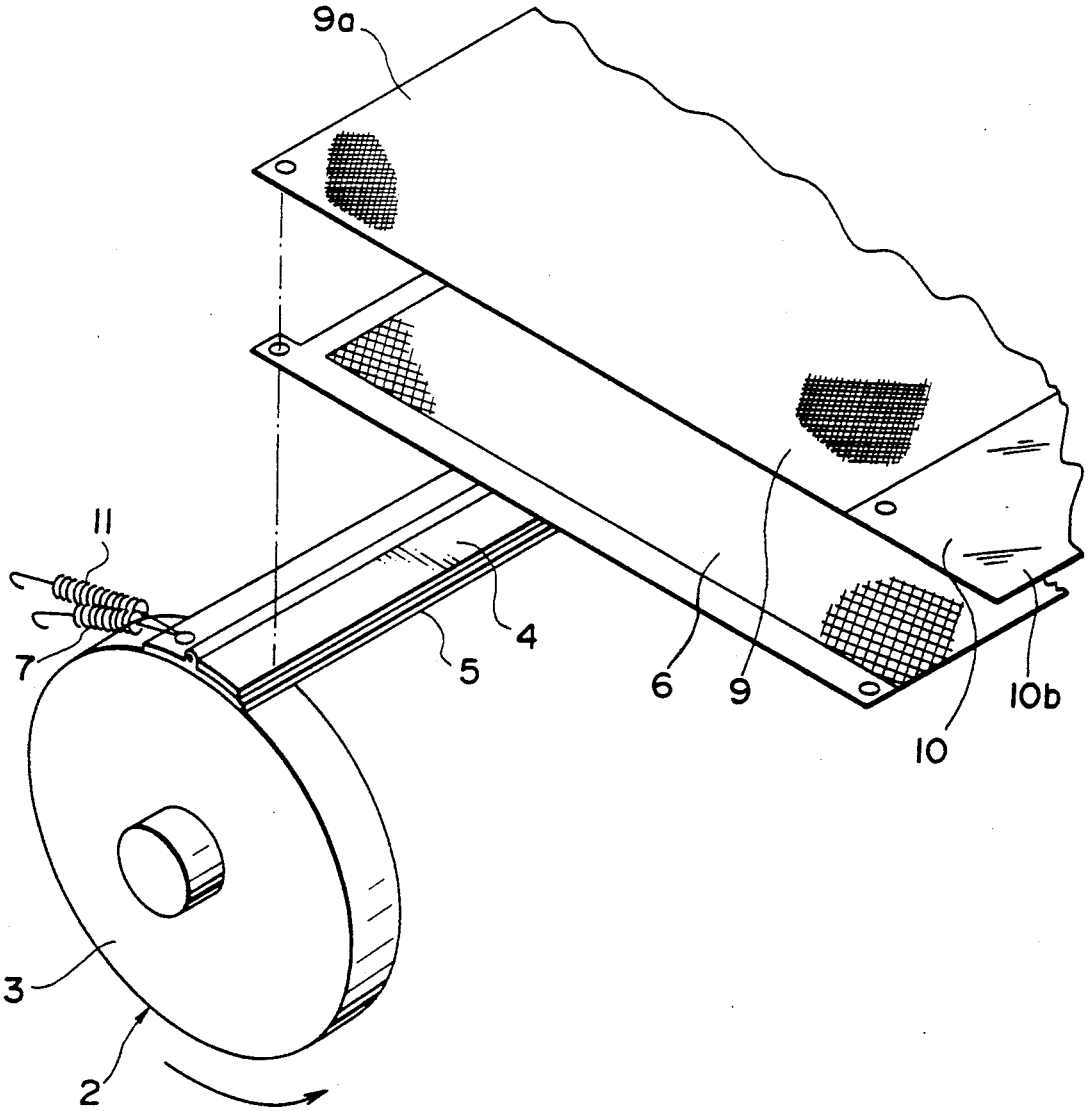
FIG. 2 is a fragmentary perspective view, with parts exploded, of the mimeographic printing machine of FIG. 1.

As shown in FIGS. 1 and 2, the mimeographic printing machine 1 has a rotary cylindrical drum 2 whose opposite ends are composed of a pair of end disks 3, 3. The two end disks 3, 3 are interconnected by a clamp device 5 including a clamping plate 4 for gripping the leading end of a stencil S. A tubular net such as of stainless wire in a sheet form is fixedly attached at its leading end to the clamp device 5 and at its trailing end to the clamp device 5 by means of an tension spring 7 to provide an ink-penetrable tubular wall 6. The tubular wall 6 does not extend throughout the entire circumferential surface of the end disk 3. In other words, between the trailing end of the tubular wall 6 of the cylindrical drum 2 and the clamp device, there is a slit-like opening 8 extending longitudinally alongside the clamping plate 4, through which the hollow interior of the cylindrical drum 2 communicates with the exterior atmosphere.

An ink-penetrable screen 9 such as of Tetron (trade name) is wound on the outer circumferential surface of the tubular wall 6 of the cylindrical drum 2. The leading end of the ink-penetrable screen 9, with the leading end of the tubular wall 6, is fixedly attached to the clamp device and the end disk 3, while the trailing end reaches the vicinity of the opening 8. The ink-penetrable screen 9 has its trailing end **9*b* to which an ink-impenetrable portion or an ink-impenetrable covering portion 10 is connected. The ink-impenetrable screen 10 also is attached at its trailing end to the clamp device 5 via an tension spring 11. At its portion connected to the ink-penetrable screen 9, the ink-impenetrable screen 10 contacts the outer circumferential surface of the tubular wall 6. A free end or trailing end 10*b* of the ink-impenetrable screen 10 is inserted into the interior hollow of the cylindrical drum 2 through the opening 8**.

Inside the cylindrical drum 2, a squeegee roller 12 is located so as to contact the inner circumferential surface of the tubular wall 6. The squeegee roller 12, whose center axis is axially aligned with the center axis of the cylindrical drum 2, is driven to rotate in the same direction as the cylindrical drum 2. A doctor roller 13 is located near the squeegee roller 12 with a predetermined space. A non-illustrated ink supply means is located between the doctor roller 13 and the squeegee roll 12 for supplying ink at need. The squeegee roller 12 presses the inner circumferential surface of the tubular wall 6 downwardly, in timed relation with the printing operation, by a non-illustrated pusher mechanism which is driven in response to the rotation of the cylindrical drum 2, so that a portion of the tubular drum 6 can projects outwardly.

The cylindrical drum 2 is operatively connected to a non-illustrated drive mechanism for rotation. A press roller 15 is located under the cylindrical drum 2 and serves as a press means for pressing a paper sheet 14 against the cylindrical drum 2. This press roller 15 is driven to rotate in the opposite direction to and in synchronism with the rotation of the cylindrical drum 2. There is defined a minute gap between the press roller 15 and the cylindrical drum 2; during printing, a print paper 14 supplied to this gap is moved forwardly as held between the cylindrical drum 2 and the press roller 15. The press roller 15 has a recess 16 at a position corresponding to the clamp device 5 of the cylindrical drum 2.

The operation of the mimeographic printing machine 1 will now be described.

Figure 3:
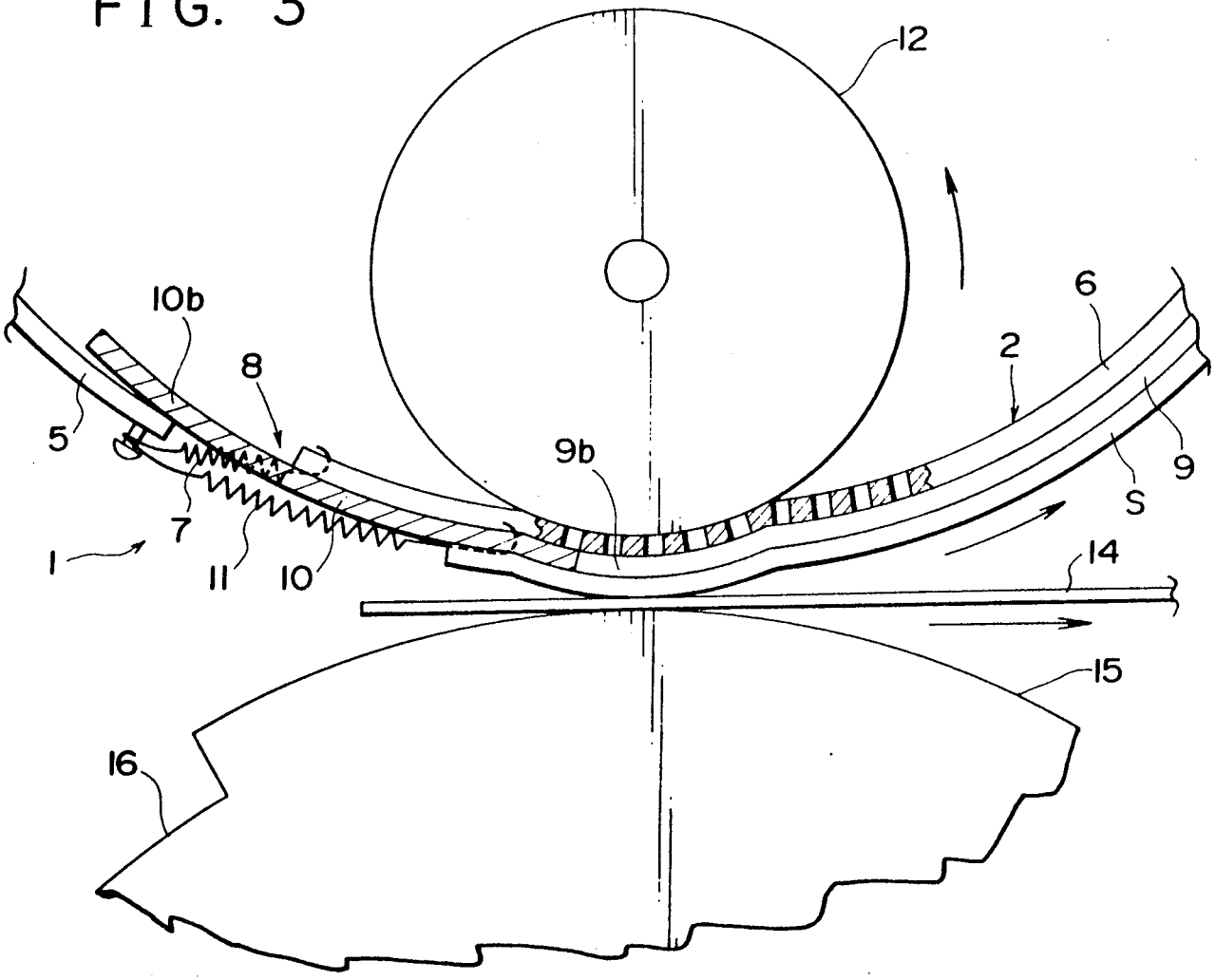
FIGS. 3 and 4 are fragmentary enlarged cross-sectional views showing the operation of the mimeographic printing machine.
Figure 4:
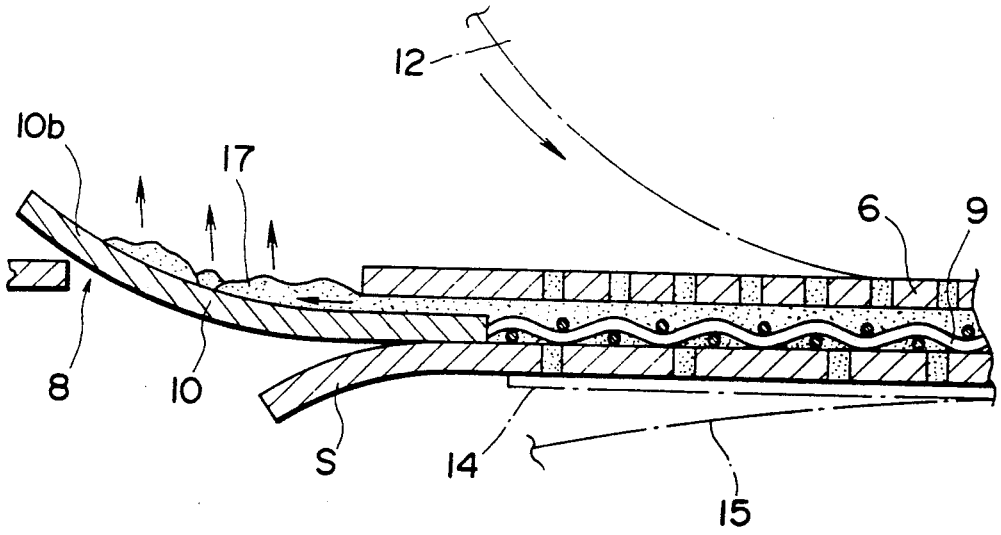

First of all, the leading end of the stencil S is gripped by the clamping plate 4 and is then wound on the outer circumferential surface of the tubular wall 6. As shown in FIGS. 3 and 4, the stencil S is longer than the ink-penetrable screen 9 and has a trailing end portion overlapping the ink-impenetrable screen 10.

As shown in FIG. 3, when the paper sheet 14 is supplied between the cylindrical drum 2 being rotated and the press roller 15, the squeegee roller 12 pushes the tubular drum 6 from the inner circumferential surface thereof toward the press roller 15 in timed relation with the supply of the paper sheet 14. The paper sheet 14 is held between the tubular wall 6 of the cylindrical drum 2 and the press roller 15.

The ink, which is supplied from the ink supply means to the inner circumferential surface of the tubular wall 6 of the cylindrical drum 2 via the squeegee roller 12, passes the ink-penetrable tubular wall 6 and the ink-penetrable screen 9 to reach the stencil S, whereupon the ink is transferred to the paper sheet 14 through the pores of the stencil S.

In this embodiment, the tubular wall 6 of the cylindrical drum 2 is deformed in response to the printing operation. Since the tubular wall 6 and the ink-penetrable screen 9 overlapped by the tubular wall 6 are tensioned by the respective tension springs 7, 11, these two members can be kept in close contact with each other. Therefore, ink is smoothly moved to the stencil S so that printing can take place normally in good condition.

As shown in FIGS. 3 and 4 the excessive ink 17 that penetrated into the tubular wall 6 of the cylindrical drum 2 but was not actually used for printing, would collect between the tubular wall 6 and the ink-penetrable screen 9 and would be pushed away toward the trailing end of the cylindrical drum 2. Subsequently the excessive ink 17 is pushed out from the ink-impenetrable screen 10 and the tubular wall 6, and is returned to the interior of the cylindrical drum 2 from the opening 8 via the ink-impenetrable screen 10.

According to this embodiment, since a small amount of excessive ink is collected between the tubular wall 6 and the ink-penetrable screen 9 in every rotation of the cylindrical drum 2 and is returned into the cylindrical drum 2 from the opening 8 via the ink-impenetrable screen 10 each time, ink will hardly leak from the trailing end of the stencil S. This would prevent the above-described "tail end leakage" phenomenon surely.

In the mimeographic printing machine of the illustrated embodiment, printing takes place on the paper sheet 14 held between the tubular wall 6 of the cylindrical drum 2 and the press roller 15 with a minute gap as the tubular wall 6 is pushed by the squeegee roller 12. However, this ink-leak-free structure can also be applied to the other type of mimeographic printing machine. For example, with the squeegee roller 12 normally in contact with the inner circumferential surface of the tubular wall 6 by a constant force, the press roller 15 may be moved upwardly and downwardly in timed relation with the supply of paper sheet. If it is unnecessary to deform the cylindrical drum 2 by pushing by the squeegee roller 12, the tubular wall 6 should not be limited to a net structure. For example, the ink-penetrable and rid tubular wall of the cylindrical drum may be a porous cylindrical structure such as of stainless steel.

In this invention, partly since the ink-penetrable screen is wound on the tubular wall of the cylindrical tube, and partly since the ink-impenetrable screen connected to the trailing end of the ink-penetrable screen is inserted into the opening of the tubular wall, any excessive ink created between the stencil and the ink-penetrable screen can be returned into the cylindrical drum from the opening via the ink-impenetrable screen. Thus it is possible to prevent ink leakage from the trailing end of the stencil.

In the illustrated embodiment, the ink-penetrable screen of Tetron (trade name) is wound on the cylindrical drum 2. The Textron screen may be omitted; for example, the cylindrical drum may be made of a rigid material having a suitable ink-penetrability and may have an opening receptive of the excessive ink. The ink-penetrable screen may be attached at one end to the edge ahead of the opening, while the other end of the ink-impenetrable may be inserted into the opening. The ink-penetrable portion and the ink-impenetrable portion of the cylindrical drum may be of the same material but different processing.

What is claimed is:

1. A mimeographic printing machine using a stencil, comprising:

a rotary cylindrical drum with an outer circumferential surface, said cylindrical drum including an ink-penetrable tubular wall for supporting the stencil therearound and a rear end, said cylindrical drum being rotatable with the stencil supported thereon, ink supply means for supplying ink inside the cylindrical drum, means for clamping a leading end of the stencil and formed on the outer circumferential surface of the cylindrical drum, said clamping means and the rear end of the ink-penetrable tubular wall forming therebetween an opening communicating with an interior of the cylindrical drum, and an ink-impenetrable covering portion disposed at the rear end of the ink-penetrable tubular wall, said ink-impenetrable covering portion extending through the opening to enter into the interior of the cylindrical drum so that ink not used for printing is returned into the interior of the cylindrical drum through the ink-impenetrable covering portion.

2. A mimeographic printing machine according to claim 1, wherein said cylindrical drum includes a tubular net constituting said tubular wall, and an attachment base having a pair of end disks attached one to opposite ends of said tubular net.

3. A mimeographic printing machine according to claim 2, wherein said tubular net is a sheet form connected at its leading end directly to said attachment base and at its trailing end to said attachment base via a tension spring.

4. A mimeographic printing machine according to claim 2, wherein said ink-impenetrable covering portion is connected to said attachment base via a tension spring.

5. A mimeographic printing machine according to claim 1, further comprising an ink-penetrable screen situated over the tubular wall, said ink-impenetrable covering portion being connected to the ink-penetrable screen and entering through the opening between the tubular wall and the clamping means into the interior of the cylindrical drum.

6. A mimeographic printing machine according to claim 1, further comprising means for holding a paper sheet disposed outside the cylindrical drum, said paper sheet passing through a space between the stencil on the outer circumferential surface of the cylindrical drum and the holding means when printing.

* * * * *